US005989602A

United States Patent [19]

Drury et al.

[11] Patent Number: 5,989,602

[45] Date of Patent: Nov. 23, 1999

[54] INFUSION PACKET

[75] Inventors: Timothy Drury, Dubai, United Arab Emirates; Dante Ghirlandi, Rotterdam, Netherlands

[73] Assignee: Lipton, Englewood Cliffs, N.J.

[21] Appl. No.: 08/997,016

[22] Filed: Dec. 23, 1997

[30] Foreign Application Priority Data

Dec. 23, 1996 [EP] European Pat. Off. ..... 96309457

[51] Int. Cl.[6] ..... B65B 29/04

[52] U.S. Cl. ..... 426/79; 426/80; 426/83

[58] Field of Search ..... 426/77, 79, 80, 426/83, 394

[56] References Cited

U.S. PATENT DOCUMENTS

| | | | |
|---|---|---|---|
| 3,767,420 | 10/1973 | Kim | 426/77 |
| 4,055,668 | 10/1977 | Kopp | 426/79 |
| 4,154,853 | 5/1979 | Rambold | 426/83 |
| 5,358,724 | 10/1994 | Raffaele | 426/83 |
| 5,366,741 | 11/1994 | Van Der Zon | 426/79 |
| 5,552,164 | 9/1996 | Krupers et al. | 426/80 |
| 5,552,165 | 9/1996 | Haak et al. | 426/80 |
| 5,674,544 | 10/1997 | Shakspeare | 426/80 |
| 5,674,545 | 10/1997 | Shakspeare et al. | 426/80 |

FOREIGN PATENT DOCUMENTS

| | | |
|---|---|---|
| 053 204 | 6/1982 | European Pat. Off. . |
| 2 170 777 | 8/1986 | United Kingdom . |
| 91/13580 | 9/1991 | WIPO . |
| 92/06903 | 4/1992 | WIPO . |
| 92/14649 | 9/1992 | WIPO . |
| WO 93/19997 | 10/1993 | WIPO . |
| 96/15033 | 5/1996 | WIPO . |

OTHER PUBLICATIONS

European Search Report in the European Application EP 96 30 9457 dated Jun. 2, 1997.

*Primary Examiner*—David Lacey
*Assistant Examiner*—Hao Mai
*Attorney, Agent, or Firm*—James J. Farrell

[57] ABSTRACT

A double compartment infusion packet has a drawstring (4) running through both compartments. The compartments are doubled over are joined together at opposite ends. The drawstring has an intermediate portion (6) retained at one end between the compartments and further portions (8) extending through the compartments to the other end where the ends of the drawstring are secured to a tag card (40). The tag card overlaps the sealing of the compartments at the other end and is secured there to the packet material. A line of weakening (42) allows the tag card to be detached to draw out the further portions of the drawstring to contract the packet and squeeze out excess moisture after infusion.

10 Claims, 3 Drawing Sheets

INFUSION PACKET

Figure 1:
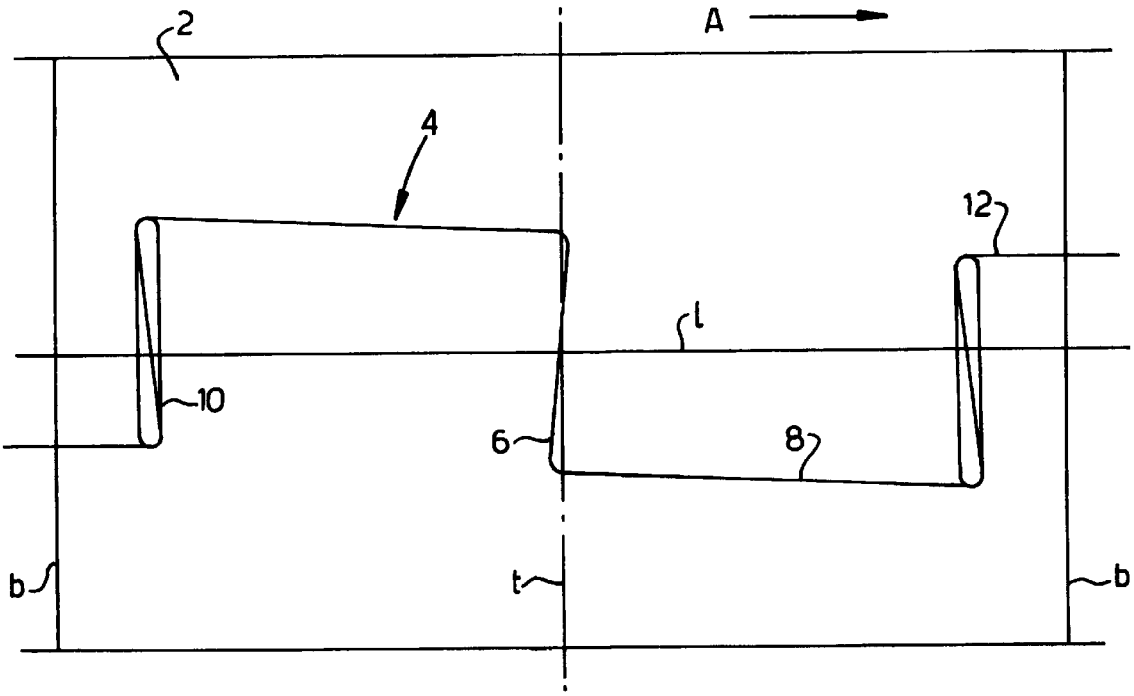

This invention relates to packets containing infusion material, such as tea or coffee, and provided with a drawstring thread for contracting the packet to extract moisture after infusion.

It has been proposed in WO96/15033 to form infusion packets using two webs on the first of which doses of infusion material are placed at intervals and on the second of which a drawstring thread is applied in a series of convoluted loops at the same pitch as the dose intervals. The two webs are then brought face to face and a pair of tag strips located adjacent one side edge of the webs. The webs are sealed together by a pattern of seals that define sealed compartments, each containing a dose of infusion material and a convoluted drawstring loop. At the same time, the tag strips are sealed to the ends of each loop. The compartments are then cut from the combined webs and the tag seal strip severed to form the individual packets each with its drawstring thread attached to a tag.

This known method produces packets having a single sealed compartment-for the infusion material. In an earlier proposal, WO91/13580, which describes another form of drawstring packet in which the drawstring thread extends through the sealed compartment of the packet there is no initial slack length of thread arranged within the packet. The thread is held in opposite end seals, and optionally the side seals of the packet. WO91/13580 also refers to the production of double-compartment packets but in that case the drawstring thread is not contained within either sealed compartment but passes between the two compartments containing doses of infusion material.

According to one aspect of the present invention, there is provided an infusion packet comprising a pair of compartments containing infusion material and joined together at opposite ends of the packet, and a drawstring extending through said compartments, an intermediate portion of the drawstring being retained at one end of the packet and further portions extending from said intermediate portion through the respective compartments to said other end of the packet to be movably held in end seals of the compartments at said other end, whereby said further portions can be pulled to tension the drawstring to contract the packet.

Preferably said further portions are arranged in a convoluted form within each compartment, whereby an excess length of drawstring thread is retained within the packet to be drawn out before the drawstring is tensioned.

The invention also provides a method of producing a drawstring packet in which the drawstring is attached to one face of a web in a convoluted pattern, said face forming an interior face of a tubular web, and is enclosed with doses of infusion material in the tubular web, transverse seals being formed at intervals along the length of the tubular web to divide it into pairs of compartments with end seals at mutually remote ends of each pair of compartments and the opposed walls of the tubular web being sealed together at a region located centrally between said end seals to define a boundary between the compartments, each said pair of compartments being doubled over to bring them together and being secured together at their ends remote from the central boundary, portions of the drawstring being retained in said secured ends and being displaceable to permit contraction of the packet by pulling the drawstring to draw the opposite ends of the packet towards each other.

Conveniently, said pairs of compartments are formed end to end along the length of the web. If a single web is used, the drawstring can be attached to a central region of the web and lateral side regions of the web are folded over the central region to enclose said drawstring and doses of material placed at intervals along the length of the web in said central region, the side edges of said margins being sealed together to produce said tubular form.

Preferably, said convoluted thread pattern is confined at least mainly to marginal regions of the compartment interiors so as to leave a clear space for depositing the dose of infusion material in each compartment. Thus, the pattern may comprise one or more loops of material extending across the major part of the width of the compartment adjacent one end thereof so that the required amount of slack can be contained in each compartment while leaving the main area of the compartment free for the dose of infusion material. To enhance the squeezing action of the drawstring, the central region sealing can be arranged to retain a portion of the drawstring thread across a major part of the width of the compartments at said one end. Preferably, said sealing comprises a plurality of seal areas between which the drawstring thread passes.

Figure 2:
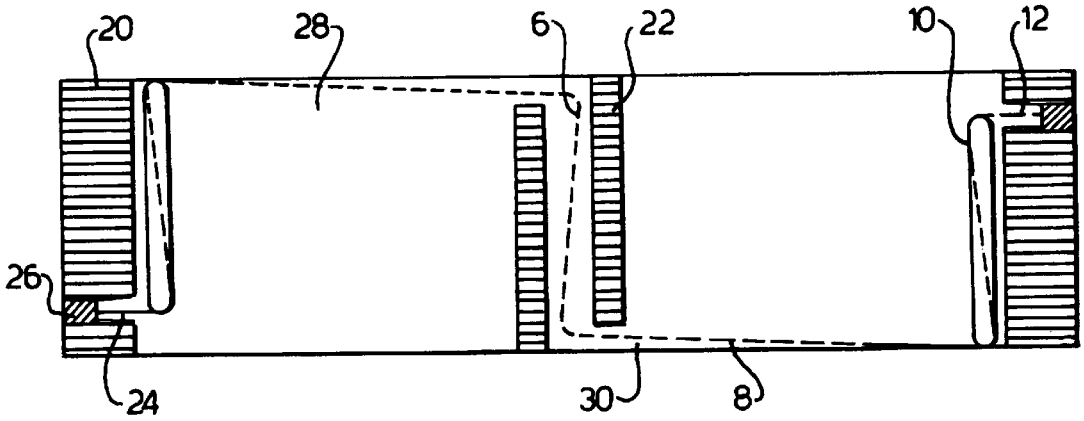
Figure 3:
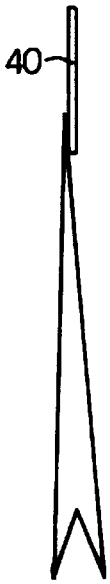
Figure 4:
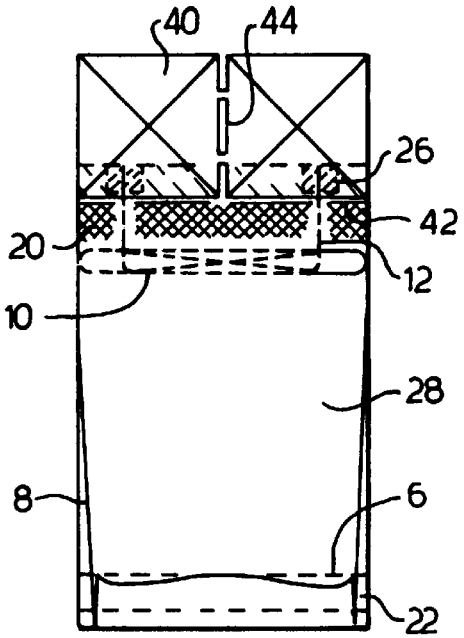
Figure 6:
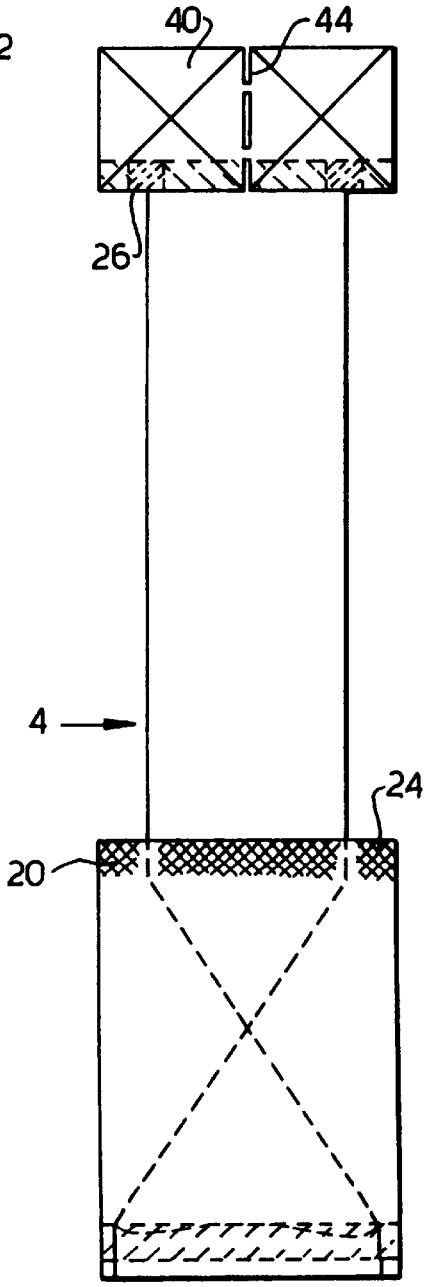
Figure 5:
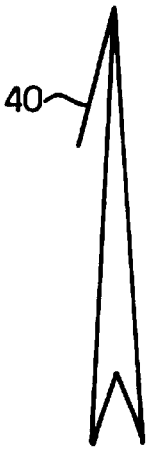
Figure 7:
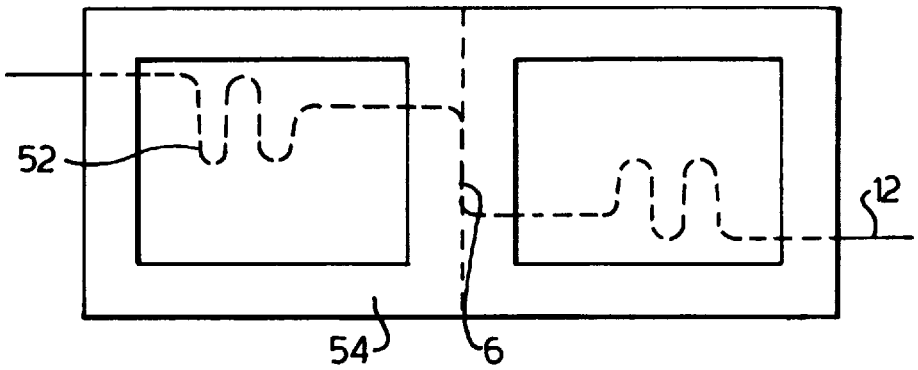
Figure 8:
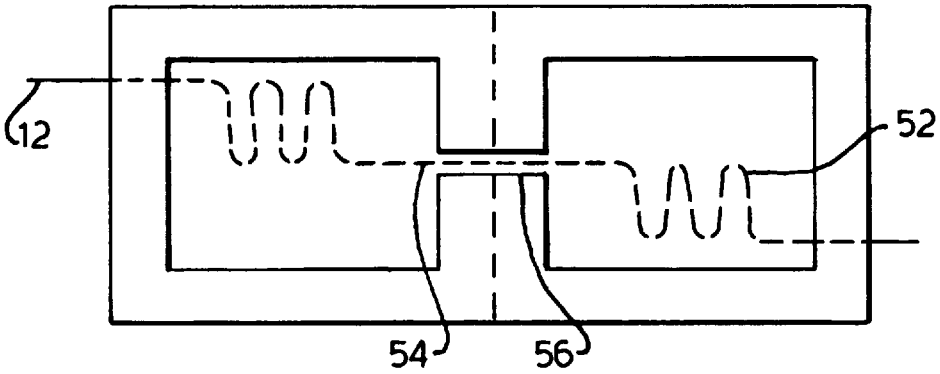
Figure 9:
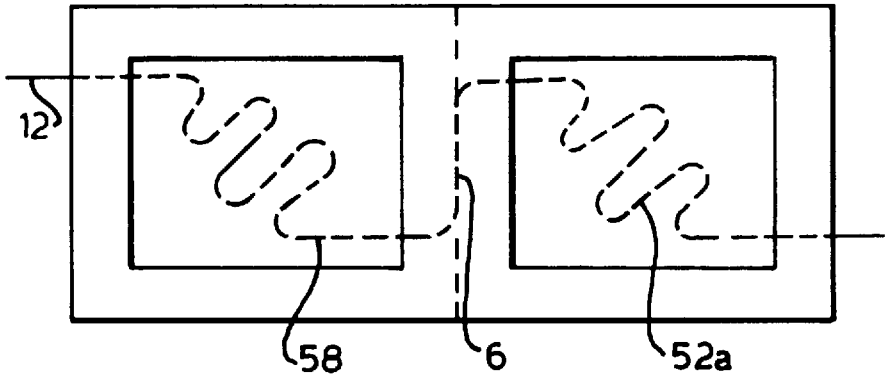

The invention will be described by way of example with reference to the accompanying schematic drawings, in which:

FIG. 1 illustrates the assembly of a drawstring with a web of packet material in a first stage of the production of a packet according to the invention, FIG. 2 illustrates a partly completed individual packet after the enclosure of the drawstring and the infusion material, FIGS. 3 and 4 are mutually transverse views illustrating the attachment of a tag to complete the packet, FIG. 5 shows the completed packet with the tag folded over for packaging, FIG. 6 shows the packet ready for infusion, and FIGS. 7 to 9 show alternative forms of infusion packets according to the invention in a partly completed form.

Referring to the method steps illustrated in the drawings, an elongate web 2 of packet material travelling in the direction A is shown in FIG. 1 with a drawstring thread 4 laid on its middle region of its width in a convoluted pattern and tacked in that pattern to the web by heat sealing means (not shown). The boundaries b indicate a length corresponding to one packet, but the web and thread can be of indefinite length.

Between the boundaries b the drawstring or thread pattern has inverted symmetry relative to a central transverse axis t. Thus, from each end of a central transverse run of an intermediate portion of drawing 6 6, which is slightly inclined to that axis and which crosses it at the centre of the packet web length, further portions 8 of the drawstring extends in longitudinal to near the opposite ends of the packet web length where in each case it forms a number of narrow transverse loops 10 in which the thread extends across the web three times. The thread continues from the loops into a terminal run 12 parallel to but offset from the central longitudinal axis 1 of the web and extends further along the web to form corresponding but reversed patterns on the further web packet lengths continuing from each end of the length shown.

Before the thread is laid onto the web and tacked in place, doses of infusion material (not shown) are placed on the web at intervals in the middle region of the web, in the spaces bounded on three sides by the transverse run of the intermediate portion of drawstring 6 and the longitudinal runs of the further drawstring portions 8 8 and the transverse loops 10. Then, with the infusion material and thread in place, the side margins of the web laterally outwards of the longitudinal runs of the further drawstring portion 8 8 are folded over and their side edges secured together by a longitudinal heat seal (not shown) to give the web a tubular form enclosing the thread and the infusion material.

Transverse seals are now made in the tubular web to define the packet compartments. As FIG. 2 shows, these comprise end seals 20 at the respective ends of the web packet length and further seal strips 22 centrally between the end seals on each side of the thread run of the intermediate drawstring portion 6. Each end seal is interrupted to form a passage 24 for the associated terminal run 12 of the thread-Another seal 26, shallower in the longitudinal direction of the web then the end seal 20, is formed between the opposite web walls at the exit ends of the passages 24 to seal the web faces and the thread together, and complete the closure of the ends of the compartments 28.

At the central region, the two transverse seal strips 22 are applied on opposite sides of the transverse centre line t across almost the full width of the tubular web but leaving passages 30 through which the longitudinal runs of the further drawstring portions 8 of the thread pass. The thread is thus not held fixed by the seal strips 22 but they retain the transverse run of the intermediate portion 6 between their confines, extending transversely across the major part of the width of the compartments, when tension is applied to the drawstring in use.

Each pair of compartments is severed from the continuous web length at this stage to give the separate packet length shown in FIG. 2. The pair of compartments are then folded over about their central region to bring the mutually remote ends together. These ends are secured together by a heat seal superimposed on the previous end seals 20. It is to be noted that this final sealing also does not extend as far as the transverse loops and that it is too leaves the passages 24 free. In the course of the folding of the tubular web, the central region is folded inwards in an inverted-V which lies between the main bodies of the compartments, as best shown in FIG. 3.

Tag means in the form of a tag card 40 is applied to the joined ends of the compartments, overlapping the end seals 20 for about half their depth at the top of the packet and also overlapping the thread seals 26. The tag card is heat-sealed in place to the web material and to the terminal runs 12 of the thread. A transverse line of weakening 42 is formed in each end seal below the thread seal 26 and substantially-coincident with the edge of the tag card. The cutting elements (not shown) forming the weakening 42 are kept from the passages 24 to maintain the thread intact. Although the terminal runs 12 are now permanently secured to the tag card 40, the drawstring is otherwise attached to the web only by weak tacking welds which hold it in its convoluted form within the packet before use.

When the packet is to be used, the tag card 40 is torn from the main body along the line of weakening 42 but it remains attached to the main body by the two terminal runs 12 of thread which extend through the passages 24. By pulling the tag away, the excess length of thread in the compartments provided by the loops 10 is drawn out to bring the packet to the state shown in FIG. 6 in which it is ready for infusion. The tag card can be torn along a central line of weakening 44 into two parts each attached to one end of the drawstring. When infusion has been completed the parts are so separated and pulled apart to tension the drawstring and contract the packet in order to squeeze excess moisture from it. It will be noted that because the transverse run of the intermediate portion 6 of the drawstring is retained between the seal strips 22, the squeezing force is applied across the full width of the bottom of the packet and the force is similarly spread at the top of the packet by the spacing of the passages 24.

Although the method of producing the packets has been described using a single web which is folded over to a tubular form, it is equally possible to produce the tubular form web using two webs which are placed face to face.

Many other modifications are of course possible within the scope of the invention, in the thread pattern for example. Some examples are shown in FIGS. 7–9, which illustrate partly completed packet at a stage similar to that in FIG. 2 of the first example. Features already described in that example are indicated by the same reference numbers.

In FIG. 7, the drawstring 4 has a series of convolutions or meanders 52 along the greater part of the length of each compartment. Edge seals 54 are shown extending with a uniform width around the entire periphery of each compartment but, in the manner described in the first example, they can be formed at the ends of the compartments with the central transverse run of the intermediate drawstring portion 6 of the thread lying between a pair of seal strips 22 (FIG. 2) that leave channels for the thread and/or with passages 24 and end seals 26 for the terminal runs 12 of the thread at the mutually remote ends of the compartments.

FIG. 8 shows similar thread convolutions or meanders 52 to those in FIG. 7 but now central run 54 of the thread between the compartments lies in the middle of the width of the web, in a central channel 56 that interrupts the adjacent end seals of the compartments. In all other respects the packets can be formed as described in the preceding examples.

In FIG. 9, the thread has a transverse central run of the intermediate drawstring portion 6 as in FIG. 7 but the convolutions or meanders 52*a* now extend across the middle of each compartment between thread portions 12,58 that pass through the opposite end seals at diagonally opposite regions.

We claim:

1. An infusion packet comprising a pair of compartments containing infusion material and joined together at opposite ends of the packet, and a drawstring positioned within said compartments and extending through said compartments, an intermediate portion of the drawstring being retained at one end of the packet and further portions extending from said intermediate portion through the respective compartments to the other end of the packet so as to be movably held in end seals of the compartments at said other end, whereby said further portions can be pulled to tension the drawstring to contract the packet.

2. A packet according to claim 1 wherein each of said compartments is sealed at said other end leaving at least one channel through a portion of the seal in which at least one drawstring pull portion is held captive but is freely slidable.

3. A packet according to claim 1 wherein, in at least one of said compartments, the associated further portion is arranged in a convoluted form, whereby an excess length of drawstring thread is retained within the packet.

4. A packet according to claim 3 wherein the excess length of thread is at least gathered adjacent said other end of the packet.

5. A packet according to claim 3 wherein said excess length is arranged in a serpentine pattern in each of said compartments extending across the width of said each of the compartments.

6. A packet according to claim 1 wherein the drawstring intermediate portion extends across the lateral extent of the packet at said one end.

7. A packet according to claim 1 wherein at said other end of the packet said further portions of the drawstring are located in laterally opposite regions of the joined compartments.

8. A packet according to claim 1 wherein tag means are attached to said further portions of the drawstring at said other end of the packet.

9. A packet according to claim 8 wherein said tag means are also attached to said other end of the packet.

10. A packet according to claim 9 wherein said packet includes an end margin and a body and said tag means are attached to said end margin of the packet separable from said main body of the packet by a line of weakening intersecting said end seals.

* * * * *